US008229290B2

(12) United States Patent
Kusuda

(10) Patent No.: US 8,229,290 B2
(45) **Date of Patent: *Jul. 24, 2012**

(54) HEAT TREATMENT APPARATUS AND METHOD FOR HEATING SUBSTRATE BY IRRADIATION THEREOF WITH LIGHT

(75) Inventor: Tatsufumi Kusuda, Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 985 days.

This patent is subject to a terminal disclaimer.

(21) Appl. No.: 12/209,244

(22) Filed: Sep. 12, 2008

(65) Prior Publication Data

US 2009/0103906 A1 Apr. 23, 2009

(30) Foreign Application Priority Data

Oct. 17, 2007 (JP) ..... 2007-269757

(51) Int. Cl.
*F26B 19/00* (2006.01)
*A45D 20/40* (2006.01)

(52) U.S. Cl. ..... 392/418; 392/407

(58) Field of Classification Search ..... None
See application file for complete search history.

(56) References Cited

U.S. PATENT DOCUMENTS

| | | | | |
|---|---|---|---|---|
| 6,376,806 | B2 | 4/2002 | Yoo | 219/411 |
| 6,936,797 | B2 | 8/2005 | Hosokawa | 219/405 |
| 6,998,580 | B2 | 2/2006 | Kusuda et al. | 219/411 |
| 6,998,680 | B2 | 2/2006 | Kitamura et al. | 257/342 |
| 7,091,114 | B2 * | 8/2006 | Ito et al. | 438/527 |
| 8,050,546 | B2 * | 11/2011 | Kusuda | 392/418 |
| 2010/0178776 | A1 * | 7/2010 | Kato | 438/795 |

* cited by examiner

*Primary Examiner* — Thor Campbell
(74) *Attorney, Agent, or Firm* — Ostrolenk Faber LLP

(57) ABSTRACT

A semiconductor wafer preheated to a preheating temperature is irradiated with light from flash lamps. With the light emission from the flash lamps, a surface temperature of the semiconductor wafer is maintained at a recovery temperature during a period of 10 to 100 milliseconds to induce recovery of defects created in silicon crystals. Then, with subsequent flashing light emission from the flash lamps, the surface temperature of the semiconductor wafer will reach a processing temperature to induce activation of impurities. Increasing the surface temperature of the semiconductor wafer once to the recovery temperature and then, with the flashing light emission, to the processing temperature will also prevent cracking of the semiconductor wafer.

12 Claims, 8 Drawing Sheets

HEAT TREATMENT APPARATUS AND METHOD FOR HEATING SUBSTRATE BY IRRADIATION THEREOF WITH LIGHT

BACKGROUND OF THE INVENTION

1. Field of the Invention

The present invention relates to heat treatment apparatus and method for heating substrates, such as semiconductor wafers or glass substrates for liquid crystal displays, by irradiation thereof with light.

2. Description of the Background Art

In general, lamp annealers using halogen lamps are conventionally used in the process for the ion activation of ion-implanted semiconductor wafers. Such lamp annealers activate ions in semiconductor wafers by heating (annealing) semiconductor wafers to temperatures of the order of, for example, 1000 to 1100° C. Such heat treatment apparatuses raise substrate temperatures at rates of the order of several hundred degrees per second, using the energy of light emitted from the halogen lamps.

Meanwhile, recent progress toward a higher integration of semiconductor devices increases the need for shallower junctions with decreasing gate lengths. It is however known that, even though the ion activation of semiconductor wafers is carried out using the aforementioned lamp annealers that raise the temperatures of semiconductor wafers at rates of the order of several hundred degrees per second, a phenomenon can still occur in which implanted ions, such as boron or phosphorus, in semiconductor wafers are deep diffused by heat. The occurrence of such a phenomenon raises a concern that junctions might get deeper than desired, thus hindering good device formation.

With this in view, U.S. Pat. Nos. 6,998,580 and 6,936,797 disclose the techniques for irradiating semiconductor wafer surfaces with flashing light emitted from xenon flash lamps so that the temperatures only on the surfaces of ion-implanted semiconductor wafers rise in a very short time (several milliseconds or less). The xenon flash lamps have a spectral distribution of radiation in the range of ultraviolet to near-infrared regions and have shorter wavelengths than conventional halogen lamps; the range of their distribution almost agrees with the fundamental absorption band of silicon semiconductor wafers. Thus, the flashing light emission from the xenon flash lamps to semiconductor wafers will produce only a small amount of transmitted light, thereby allowing a rapid rise in the temperatures of the semiconductor wafers. It is also known that the flashing light emission in a very short time of several milliseconds or less causes a selective rise in temperature only in the vicinity of the surfaces of semiconductor wafers. Thus, the very-short-time rise in temperature with the xenon flash lamps achieves only the ion activation without causing deep diffusion of ions.

The high-energy ion implantation during the ion implantation process prior to the flash heating process, however, results in generation of a number of defects in silicon crystals on semiconductor wafers. The very-short-time temperature rise with the xenon flash lamps achieves the ion activation, but it will not eliminate the defects generated.

Further in the heat treatment apparatuses with the xenon flash lamps, instantaneous irradiation of semiconductor wafers with flashing light with extremely high energy causes an instantaneous and rapid rise in the surface temperatures of semiconductor wafers. This undesirably causes sudden thermal expansion of the wafer surfaces, resulting in cracking of the semiconductor wafers.

SUMMARY OF THE INVENTION

The invention is directed to a heat treatment apparatus for heating a substrate by irradiation thereof with light.

According to an aspect of the invention, the heat treatment apparatus includes a holder holding a substrate; a flash lamp emitting light to the substrate held by the holder; a switching element connected in series to the flash lamp, a capacitor, and a coil; a pulse-signal generator generating and outputting a pulse signal including one or more pulses to the switching element to control drive of the switching element; and a waveform setter setting a waveform of the pulse signal generated by the pulse-signal generator. The waveform setter sets a waveform that causes a surface temperature of the substrate held by the holder to change in such a manner that, with light emission from the flash lamp, the surface temperature is maintained during a certain period of time within a first temperature range that induces recovery of defects, and then with subsequent flashing light emission from the flash lamp, the surface temperature reaches a second temperature that is higher than the first temperature range and that induces activation of impurities.

The light emission from the flash lamp is caused by outputting to the switching element a pulse signal with the waveform that causes the surface temperature of the substrate held by the holder to change in such a manner that, with light emission from the flash lamp, the surface temperature is maintained during a certain period of time within the first temperature range that induces recovery of defects, and then with subsequent flashing light emission from the flash lamp, the surface temperature reaches the second temperature that is higher than the first temperature range and that induces activation of impurities. In this case, the surface temperature of the substrate is first maintained within the first temperature range to induce recovery of defects and then reaches the second temperature to induce activation of impurities. Increasing the surface temperature once to the first temperature range and then, with the flashing light emission, to the second temperature will produce less thermal shock on the substrate at the time of the flashing light emission, thus preventing substrate cracking.

According to another aspect of the invention, the heat treatment apparatus includes: a holder holding a substrate; a flash lamp emitting light to the substrate held by the holder; a switching element connected in series to the flash lamp, a capacitor, and a coil; and a pulse-signal generator generating and outputting a pulse signal including one or more pulses to the switching element to control turning on and off of the switching element. The pulse-signal generator first repeats the turning on and off of the switching element so that, with light emission from the flash lamp, a surface temperature of the substrate held by the holder is maintained during a certain period of time within a first temperature range that induces recovery of defects; and then turns the switching element on so that, with flashing light emission from the flash lamp, the surface temperature reaches a second temperature that is higher than the first temperature range and that induces activation of impurities.

The turning on and off of the switching element is controlled so that, with the light emission from the flash lamp, the surface temperature of the substrate held by the holder is maintained during a certain period of time within the first temperature range that induces recovery of defects, and with the subsequent flashing light emission from the flash lamp, the surface temperature reaches the second temperature that is higher than the first temperature range and that induces activation of impurities. In this case, the surface temperature of the substrate is first maintained within the first temperature range to induce recovery of defects and then reaches the second temperature to induce activation of impurities. Increasing the surface temperature of the substrate once to the first temperature range and then, with the flashing light emission, to the second temperature will produce less thermal shock on the substrate at the time of the flashing light emission, thus preventing substrate cracking.

The invention is also directed to a heat treatment method for heating a substrate by irradiation thereof with light from a flash lamp.

According to still another aspect of the invention, the heat treatment method includes a waveform setting step of setting a waveform of a pulse signal including one or more pulses; and a light emitting step of outputting the pulse signal to a switching element to control drive of the switching element and thereby cause light emission from the flash lamp, the switching element being connected in series to a capacitor, a coil, and the flash lamp. The waveform setting step sets a waveform that causes a surface temperature of a substrate to change in such a manner that, with light emission from the flash lamp, the surface temperature is maintained during a certain period of time within a first temperature range that induces recovery of defects, and then with subsequent flashing light emission from the flash lamp, the surface temperature reaches a second temperature that is higher than the first temperature range and that induces activation of impurities.

The light emission from the flash lamp is caused by outputting to the switching element a pulse signal with the waveform that causes the surface temperature of the substrate to change in such a manner that, with the light emission from the flash lamp, the surface temperature is maintained during a certain period of time within the first temperature range that induces recovery of defects, and then with the subsequent flashing light emission from the flash lamp, the surface temperature reaches the second temperature that is higher than the first temperature range and that induces activation of impurities. In this case, the surface temperature of the substrate is first maintained within the first temperature range to induce recovery of defects and then reaches the second temperature to induce activation of impurities. Increasing the surface temperature of the substrate once to the first temperature range and then, with the flashing light emission, to the second temperature will produce less thermal shock on the substrate at the time of the flashing light emission, thus preventing substrate cracking.

According to still another aspect of the invention, the heat treatment method includes a first heating step of causing light emission from the flash lamp so that a surface temperature of a substrate is maintained during a certain period of time within a first temperature range that induces recovery of defects; and a second heating step of, after the first heating step, causing flashing light emission from the flash lamp to the substrate so that the surface temperature reaches a second temperature that is higher than the first temperature range and that induces activation of impurities.

With the light emission from the flash lamp, the surface temperature of the substrate is maintained during a certain period of time within the first temperature range that induces recovery of defects, and with the subsequent flashing light emission from the flash lamp to the substrate, the surface temperature of the substrate reaches the second temperature that is higher than the first temperature range and that induces activation of impurities. In this case, the surface temperature of the substrate is first maintained within the first temperature range to induce recovery of defects and then reaches the second temperature to induce activation of impurities. Increasing the surface temperature of the substrate once to the first temperature range and then, with the flashing light emission, to the second temperature will produce less thermal shock on the substrate at the time of the flashing light emission, thus preventing substrate cracking.

It is therefore an object of the invention to achieve both recovery of defects and activation of impurities as well as to prevent substrate cracking.

These and other objects, features, aspects and advantages of the invention will become more apparent from the following detailed description of the invention when taken in conjunction with the accompanying drawings.

DESCRIPTION OF THE PREFERRED EMBODIMENTS

Preferred embodiments of the invention are now described below in detail with reference to the drawings.

Figure 1:
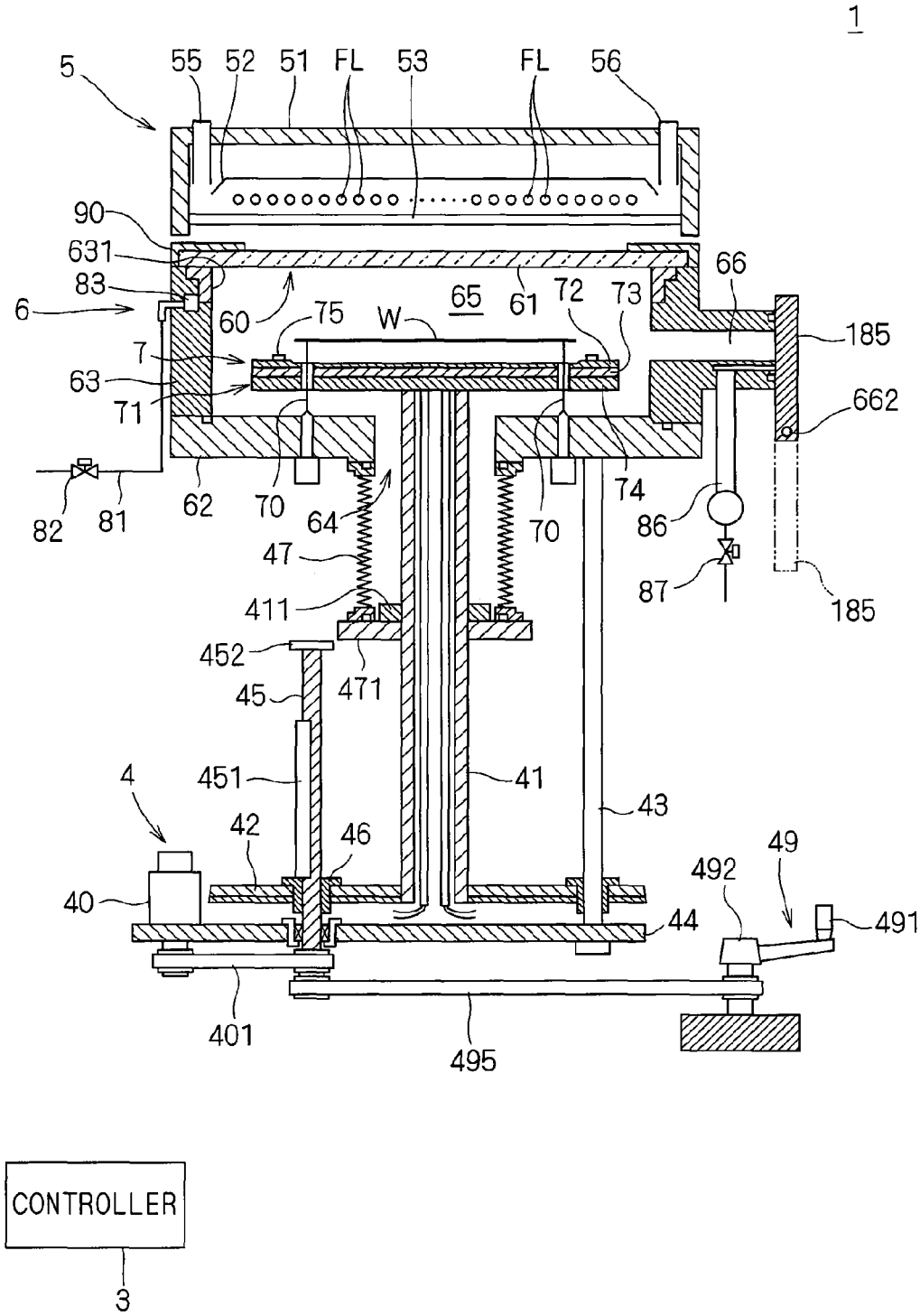
FIG. 1 is a side sectional view showing a configuration of a heat treatment apparatus according to the invention.

First, a general configuration of a heat treatment apparatus according to the invention is outlined. FIG. 1 is a side sectional view showing a configuration of a heat treatment apparatus 1 according to the invention. The heat treatment apparatus 1 is a lamp annealer that heats a substrate, such as a generally-circular semiconductor wafer W, by irradiation thereof with light.

The heat treatment apparatus 1 includes a generally-cylindrical chamber 6 receiving a semiconductor wafer W therein; and a lamp house 5 including a plurality of built-in flash lamps FL. The heat treatment apparatus 1 further includes a controller 3 that controls and causes operating mechanisms in the chamber 6 and in the lamp house 5 to perform heat treatment on a semiconductor wafer W.

The chamber 6 is provided below the lamp house 5 and includes a chamber side portion 63 having a generally-cylindrical inner wall and a chamber bottom portion 62 covering the lower part of the chamber side portion 63. A space surrounded by the chamber side portion 63 and the chamber bottom portion 62 is defined as a heat treatment space 65. Above the heat treatment space 65 is a top opening 60 that is equipped with and blocked by a chamber window 61.

The chamber window 61 forming a ceiling of the chamber 6 is a disk-shaped member made of quartz and serves as a quartz window that transmits light emitted from the lamp house 5 into the heat treatment space 65. The chamber bottom portion 62 and the chamber side portion 63, which are the main body of the chamber 6, are made of, for example, a metal material with high strength and high heat resistance, such as stainless steel, whereas a ring 631 on the upper inner side of the chamber side portion 63 is made of a material such as an aluminum (Al) alloy that has greater durability than stainless steel against degradation caused by light emission.

The chamber bottom portion 62 has a plurality of (three, in this preferred embodiment) support pins 70 extending upright therefrom through a holder 7 so as to support a semiconductor wafer W from the underside (the surface opposite the surface irradiated with light emitted from the lamp house 5) of the semiconductor wafer W. The support pins 70 are made of, for example, quartz and secured from outside the chamber 6 so that they are easy to replace.

The chamber side portion 63 has a transport opening 66 for transport of a semiconductor wafer W into and out of the chamber 6. The transport opening 66 will be opened and closed by a gate valve 185 that turns on an axis 662. On the opposite side of the chamber side portion 63 from the transport opening 66, there is formed an introduction path 81 to introduce a processing gas (e.g., an inert gas such as a nitrogen ($N_2$) gas, a helium (He) gas, or an argon (Ar) gas, an oxygen ($O_2$) gas, or the like) into the heat treatment space 65. The introduction path 81 has one end connected through a valve 82 to a gas supply mechanism, not shown, and the other end connected to a gas introduction buffer 83 formed inside the chamber side portion 63. In the transport opening 66, there is formed an exhaust path 86, from which a gas in the heat treatment space 65 is exhausted. The exhaust path 86 is connected through a valve 87 to an exhaust mechanism not shown.

Figure 2:
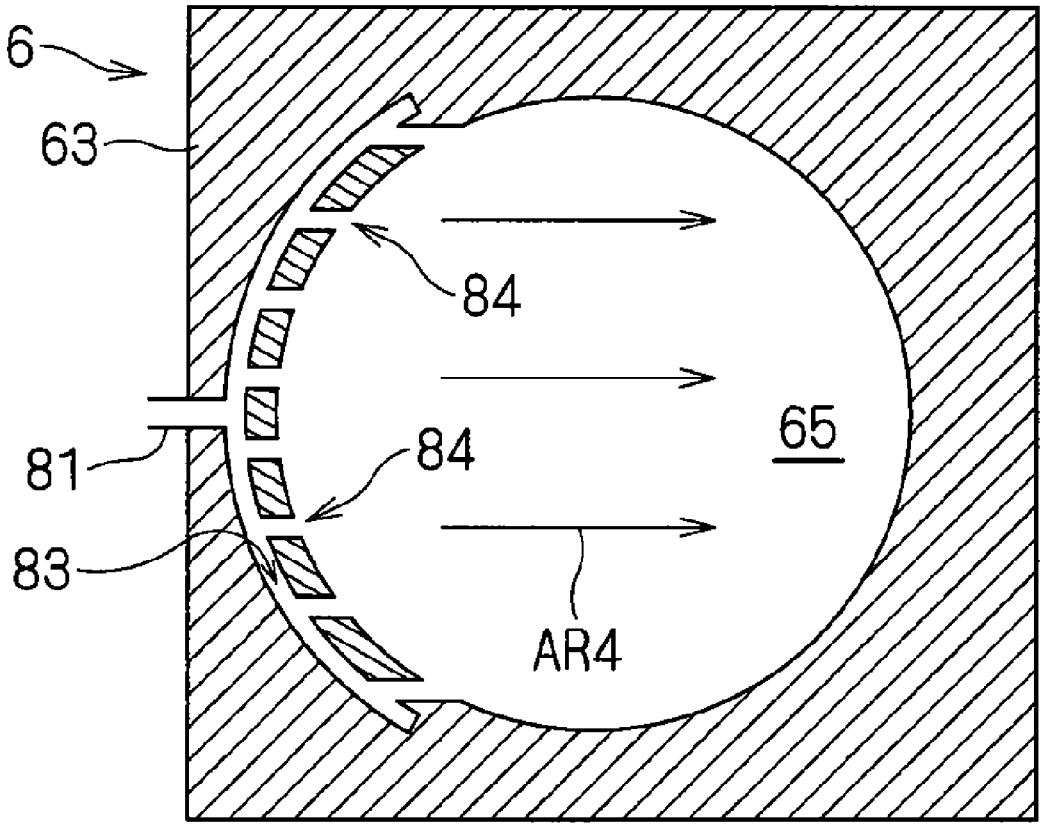
FIG. 2 is a sectional view showing the path of a gas in the heat treatment apparatus in FIG. 1.

FIG. 2 is a sectional view of the chamber 6 taken along a horizontal plane at the level of the gas introduction buffer 83. As shown in FIG. 2, the gas introduction buffer 83 is formed to extend over about one third of the inner periphery of the chamber side portion 63 on the side opposite the transport opening 66 in FIG. 1, so that the processing gas introduced into the gas introduction buffer 83 through the introduction path 81 is supplied to the heat treatment space 65 through a plurality of gas supply holes 84.

The heat treatment apparatus 1 further includes the generally disk-shaped holder 7 that preheats a semiconductor wafer W prior to irradiation thereof with light while holding the semiconductor wafer W in a horizontal position inside the chamber 6; and a holder elevating mechanism 4 that moves the holder 7 up and down relative to the chamber bottom portion 62 which is the bottom of the chamber 6. The holder elevating mechanism 4 in FIG. 1 includes a generally-cylindrical shaft 41, a movable plate 42, guide members 43 (in this preferred embodiment, three guide members 43 provided around the shaft 41), a fixed plate 44, a ball screw 45, a nut 46, and a motor 40. The chamber bottom portion 62, which is the bottom of the chamber 6, has a generally-circular bottom opening 64 with a smaller diameter than the holder 7. The shaft 41 of stainless steel is inserted and connected through the bottom opening 64 to the underside of the holder 7 (strictly speaking, a hot plate 71 of the holder 7) so as to support the holder 7.

The nut 46, which is in threaded engagement with the ball screw 45, is fixed to the movable plate 42. The movable plate 42 is vertically movable by being slidably guided by the guide members 43 that are fixed to and extend downwardly from the chamber bottom portion 62. The movable plate 42 is coupled to the holder 7 through the shaft 41.

The motor 40 is installed on the fixed plate 44 mounted to the lower ends of the guide members 43 and is connected to the ball screw 45 through a timing belt 401. When the holder elevating mechanism 4 moves the holder 7 up and down, the motor 40 as a driver rotates the ball screw 45 under the control of the controller 3 so that the movable plate 42 fixed to the nut 46 moves vertically along the guide members 43. The result is that the shaft 41 fixed to the movable plate 42 moves vertically so that the holder 7 connected to the shaft 41 smoothly moves up and down between a transfer position for transfer of a semiconductor wafer W, shown in FIG. 1, and a processing position for processing of the semiconductor wafer W, shown in FIG. 5.

On the upper surface of the movable plate 42, a mechanical stopper 451 of a generally-semi-cylindrical shape (the shape obtained by cutting a cylinder in half along its length) extends upright along the ball screw 45. Even if something unusual happens to cause the movable plate 42 to move up beyond a certain upper limit, the top end of the mechanical stopper 451 will strike an end plate 452 at the end of the ball screw 45, which prevents an abnormal upward movement of the movable plate 42. This prevents the holder 7 from moving up beyond a certain level under the chamber window 61, thereby avoiding a collision of the holder 7 with the chamber window 61.

The holder elevating mechanism 4 further includes a manual elevator 49 that manually moves the holder 7 up and down for maintenance of the interior of the chamber 6. The manual elevator 49 includes a handle 491 and a rotary shaft 492, and by rotating the rotary shaft 492 with the handle 491, rotates the ball screw 45 connected through a timing belt 495 to the rotary shaft 492 so as to allow vertical movements of the holder 7.

On the underside of the chamber bottom portion 62, expandable and contractible bellows 47 are provided to extend downwardly around the shaft 41, with their upper ends connected to the underside of the chamber bottom portion 62. The bottom ends of the bellows 47 are mounted to a bellows-bottom-end plate 471. The bellows-bottom-end plate 471 is screwed to the shaft 41 with a collar member 411. The bellows 47 contract when the holder elevating mechanism 4 moves the holder 7 upward relative to the chamber bottom portion 62, while they expand when the holder elevating mechanism 4 moves the holder 7 downward. The expansion and contraction of the bellows 47 keeps the heat treatment space 65 air-tight even during upward and downward movements of the holder 7.

Figure 3:
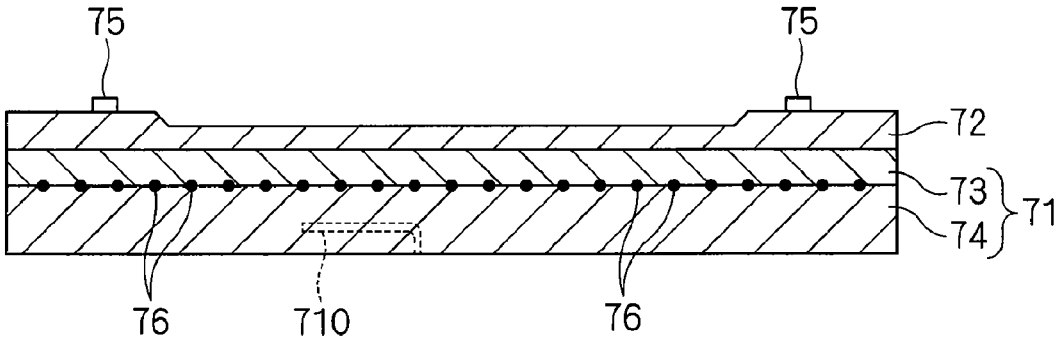
FIG. 3 is a sectional view showing the structure of a holder.

FIG. 3 is a sectional view showing the structure of the holder 7. The holder 7 includes the hot plate (heating plate) 71 for preheating (what is called assisted heating) of a semiconductor wafer W; and a susceptor 72 installed on the upper surface (the surface on which the holder 7 holds a semiconductor wafer W) of the hot plate 71. The underside of the holder 7 is, as previously described, connected to the shaft 41 that causes the holder 7 to move up and down. The susceptor 72 is made of quartz (or may be of aluminum nitride (AlN) or the like) and has, on the upper surface, pins 75 that prevent misalignment of a semiconductor wafer W. The susceptor 72 is installed on the hot plate 71 with the underside in face-to-face contact with the upper surface of the hot plate 71. The susceptor 72 is thus capable of diffusing and transmitting heat energy from the hot plate 71 to a semiconductor wafer W placed on the upper surface as well as being removed from the hot plate 71 for cleaning during maintenance.

The hot plate 71 includes an upper plate 73 and a lower plate 74, both made of stainless steel. In the space between the upper and lower plates 73 and 74, resistance heating wires 76, such as nichrome wires, are installed for use in heating the hot plate 71, and the space is filled and sealed with an electrically conductive brazing metal containing nickel (Ni). The upper and lower plates 73 and 74 are brazed or soldered to each other at the ends.

Figure 4:
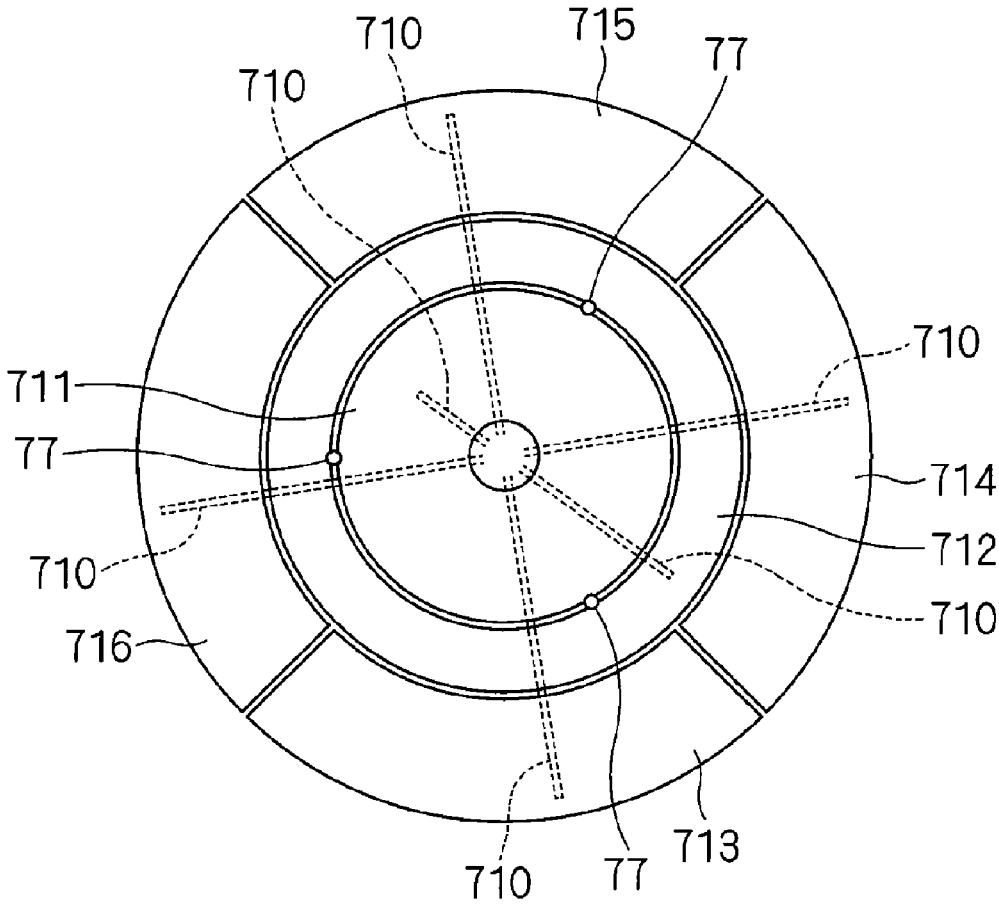
FIG. 4 is a plan view of a hot plate.

FIG. 4 is a plan view of the hot plate 71. As shown in FIG. 4, the hot plate 71 has a disk-shaped zone 711 and a ring-shaped zone 712 that are concentrically arranged in the center section of an area that faces a semiconductor wafer W being held; and four zones 713 to 716 that are obtained by equally and circumferentially dividing a generally-ring-shaped area that surrounds the zone 712. There is a slight space between each adjacent pair of the zones. The hot plate 71 further has three through holes 77 that receive the support pins 70 therethrough and that are circumferentially spaced 120° apart from one another in the space between the zones 711 and 712.

In each of the six zones 711 to 716, the resistance heating wires 76, independent of one another, are installed to circulate therearound to form a separate heater, so that each zone is separately heated by its own built-in heater. A semiconductor wafer W held by the holder 7 is heated by those built-in heaters in the six zones 711 to 716. Each of the zones 711 to 716 has a sensor 710 that measures the temperature in each zone with a thermocouple. Each sensor 710 is connected to the controller 3 through the inside of the generally-cylindrical shaft 41.

When heating the hot plate 71, the controller 3 controls the amounts of power supplied to the resistance heating wires 76 in each of the six zones 711 to 716 so that the temperature in each zone measured by the sensor 710 becomes a given preset temperature. The temperature control for each zone using the controller 3 is under PID (proportional-integral-derivative) control. At the hot plate 71, the temperatures in the zones 711 to 716 continue to be measured until the heat treatment of a semiconductor wafer W (or the heat treatment of all semiconductor wafers W, if there a plurality of semiconductor wafers W to be processed successively) is complete, and the amount of power supplied to the resistance heating wires 76 in each zone, i.e., the temperature of the built-in heater in each zone, is individually controlled, so that the temperature in each zone is kept at a set temperature. The set temperature for each zone may be changed by an offset value that is individually determined by a reference temperature.

The resistance heating wires 76 installed in the six zones 711 to 716 are connected to a power supply source (not shown) through power lines passing through the inside of the shaft 41. On the way from the power supply source to each zone, the power lines from the power supply source are arranged so as to be electrically insulated from one another inside a stainless tubes filled with an insulator such as magnesia (magnesium oxide). The inside of the shaft 41 is open to the atmosphere.

The lamp house 5 includes, inside a case 51, a light source including a plurality of (30, in this preferred embodiment) xenon flash lamps FL, and a reflector 52 provided to cover over the light source. The case 51 of the lamp house 5 has a lamp-light irradiation window 53 at the bottom. The lamp-light irradiation window 53, which forms the floor of the lamp house 5, is a plate-like member made of quartz. The lamp house 5 is located over the chamber 6 so that the lamp-light irradiation window 53 is opposed to the chamber window 61. The lamp house 5 irradiates a semiconductor wafer W held by the holder 7 in the chamber 6, with light emitted from the flash lamps FL through the lamp-light irradiation window 53 and the chamber window 61, to thereby heat the semiconductor wafer W.

The plurality of flash lamps FL, each of which are rod-like lamps in the shape of elongated cylinders, are arrayed in a plane so that they are longitudinally parallel to one another along the major surface of a semiconductor wafer W held by the holder 7 (i.e., in the horizontal direction). Thus, the plane defined by the array of the flash lamps FL is also a horizontal plane.

Figure 6:
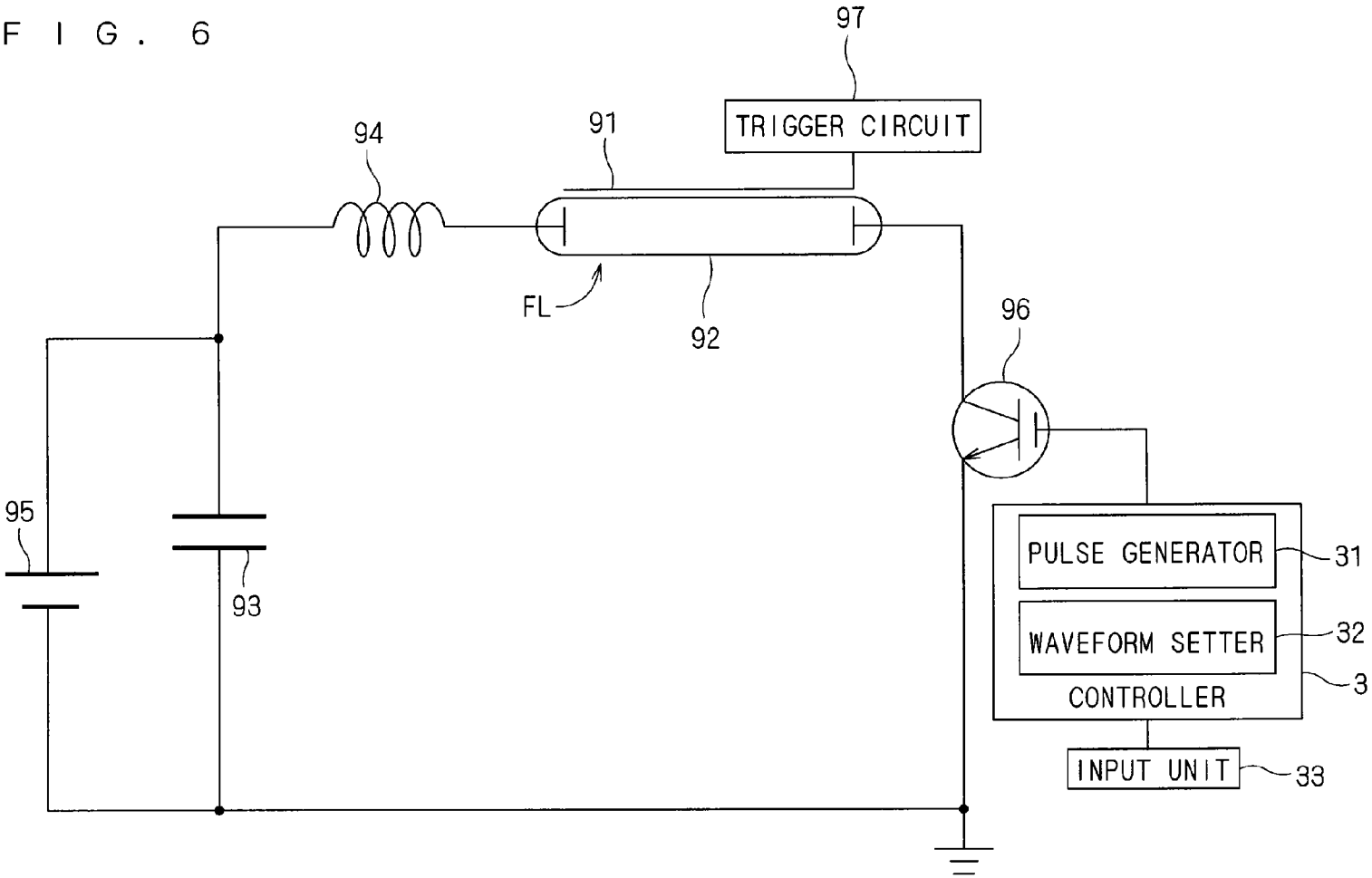
FIG. 6 shows a driving circuit for a flash lamp.

FIG. 6 shows a driving circuit for a flash lamp FL. As shown, a capacitor 93, a coil 94, a flash lamp FL, and a switching element 96 are connected in series. The flash lamp FL includes a rod-like glass tube (discharge tube) 92 containing xenon gas sealed therein and having positive and negative electrodes at opposite ends; and a trigger electrode 91 annexed on the outer peripheral surface of the glass tube 92. The capacitor 93 receives a given voltage applied from a power supply unit 95 and accumulates a charge in response to the applied voltage. The trigger electrode 91 will receive a voltage applied from a trigger circuit 97. The timing of the voltage application from the trigger circuit 97 to the trigger electrode 91 is under the control of the controller 3.

The present preferred embodiment employs an insulated-gate bipolar transistor (IGBT) as the switching element 96. The IGBT is a bipolar transistor that incorporates a MOSFET (metal-oxide-semiconductor field-effect transistor) into the gate, and it is a switching element suitable for handling a large amount of power. The switching element 96 receives at its gate, a pulse signal from a pulse generator 31 in the controller 3.

Even if with the capacitor 93 in the charged state, a pulse is output to the gate of the switching element 96 so that high voltage is applied to the electrodes across the glass tube 92, no current will flow in the glass tube 92 under normal conditions because of the electrically insulative property of a xenon gas. However if the trigger circuit 97 breaks the insulation by the application of voltage to the trigger electrode 91, a current will instantaneously flow between the electrodes across the glass tube 92, and resultant excitation of atoms or molecules of xenon will induce light emission.

The reflector 52 in FIG. 1 is provided above the plurality of flash lamps FL so as to cover over those lamps. The fundamental function of the reflector 52 is to reflect light emitted from the plurality of flash lamps FL toward the holder 7. The reflector 52 is an aluminum-alloy plate with one surface (the surface on the side facing the flash lamps FL) roughened by abrasive blasting to have a satin finish. The reason for such surface roughing is that if the reflector 52 has a perfect mirror surface, the intensity of reflected light from the plurality of flash lamps FL will exhibit a regular pattern, which can cause deterioration in the uniformity of surface temperature distribution across a semiconductor wafer W.

The controller 3 controls the aforementioned various operating mechanisms in the heat treatment apparatus 1. The controller 3 is similar in hardware construction to general computers. Specifically, the controller 3 includes a CPU performing various computations; a ROM which is a read-only memory storing basic programs, a RAM which is a readable/writable memory storing various pieces of information; and a magnetic disk that stores control software, data, and the like. The controller 3 further includes the pulse generator 31 and a waveform setter 32, and it is connected to an input unit 33. The input unit 33 may be any of various known input equipment such as a keyboard, a mouse, or a touch panel. The waveform setter 32 sets the waveform of a pulse signal based on the contents of input from the input unit 33, and the pulse generator 31 generates a pulse signal with that waveform.

In addition to the components described above, the heat treatment apparatus 1 further includes various structures for cooling in order to prevent an excessive temperature rise in the chamber 6 and in the lamp house 5 due to heat energy generated by the flash lamps FL and the hot plate 71 during the heat treatment of a semiconductor wafer W. For instance, a water cooling tube (not shown) is provided in the chamber side portion 63 and the chamber bottom portion 62 of the chamber 6. The lamp house 5 provides an air-cooling system (cf. FIGS. 1 and 5) with a gas supply pipe 55 and an exhaust gas pipe 56 for forming an internal gas flow to exhaust heat. Air is also supplied into the space between the chamber window 61 and the lamp-light irradiation window 53 in order to cool the lamp house 5 and the chamber window 61.

Next, the procedure for processing a semiconductor wafer W in the heat treatment apparatus 1 is described. A semiconductor wafer W to be processed herein is a semiconductor substrate with impurities (ions) implanted by ion implantation. The heat treatment apparatus 1 performs photoheating (photoannealing) of a semiconductor wafer W for the activation of implanted impurities.

Figure 5:
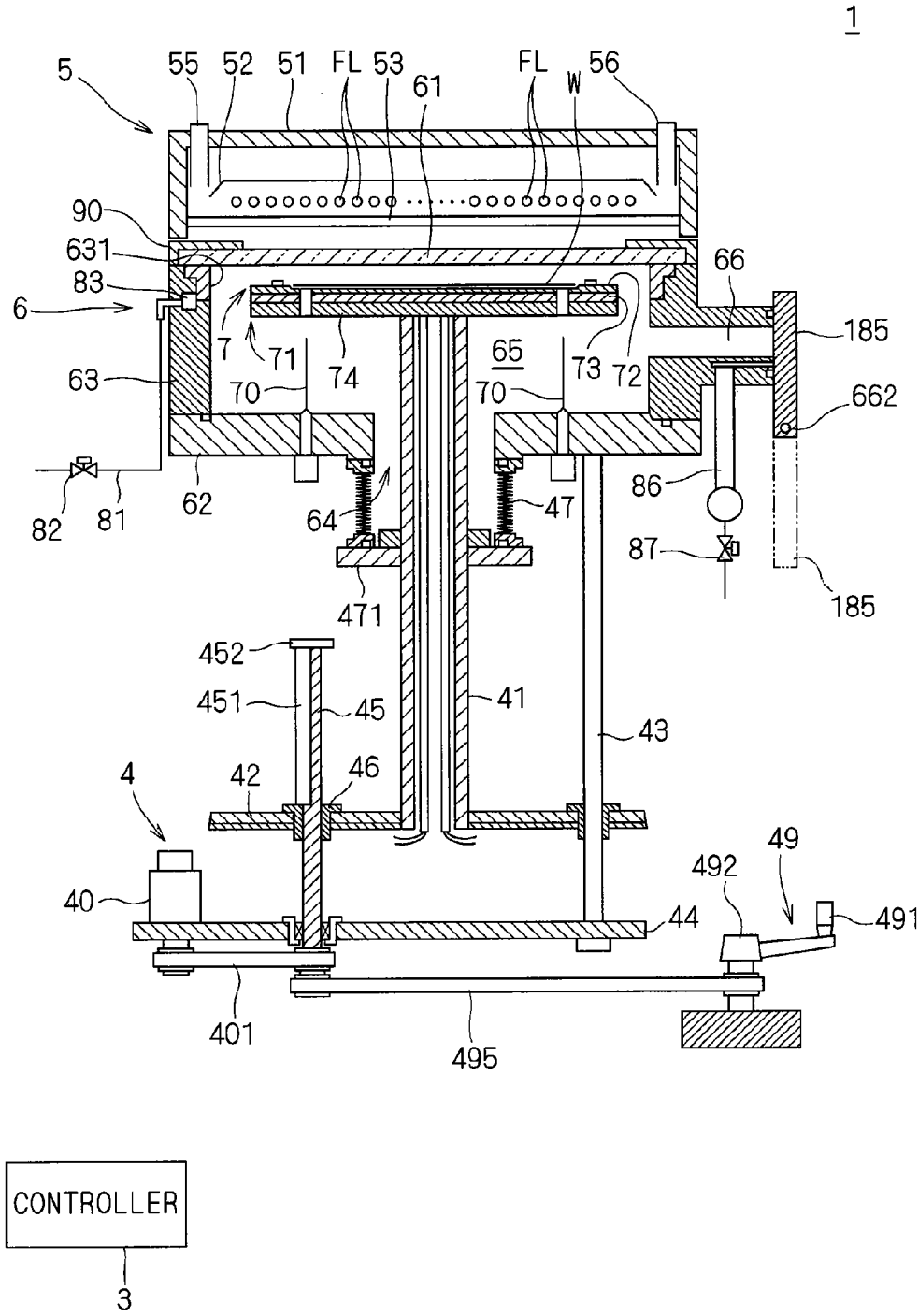
FIG. 5 is a side sectional view showing the configuration of the heat treatment apparatus in FIG. 1.

First, the holder 7 is moved down from the processing position in FIG. 5 to the transfer position in FIG. 1. The "processing position" refers to the position of the holder 7 in the chamber 6 in FIG. 5 when the semiconductor wafer W is irradiated with light emitted from the flash lamps FL. The "transfer position" refers to the position of the holder 7 inside the chamber 6 in FIG. 1 when the semiconductor wafer W is transported into and out of the chamber 6. A reference position of the holder 7 in the heat treatment apparatus 1 is the processing position; that is, the holder 7 is in the processing position prior to processing, and upon the start of processing, moves down to the transfer position. When moved down to the transfer position as shown in FIG. 1, the holder 7 is in close proximity to the chamber bottom portion 62, so that the upper ends of the support pins 70 protrude through the holder 7 upwardly above the holder 7.

When the holder 7 is moved down to the transfer position, the valves 82 and 87 are opened to introduce a nitrogen gas at room temperature into the heat treatment space 65 of the chamber 6. The gate valve 185 is then opened to open the transport opening 66, so that the semiconductor wafer W is transported through the transport opening 66 into the chamber 6 and placed on the plurality of support pins 70 by a transport robot outside the apparatus.

The nitrogen gas supplied into the chamber 6 at the time of transport of the semiconductor wafer W shall be purged from the chamber 6 at rates of about 40 L/min. The nitrogen gas supplied will flow from the gas introduction buffer 83 in the direction of the arrows AR4 in FIG. 2 within the chamber 6 and will be exhausted by a utility exhaust system through the exhaust path 86 and the valve 87 in FIG. 1. Part of the nitrogen gas supplied into the chamber 6 will also be exhausted from an exhaust port (not shown) inside the bellows 47. In each step described below, the nitrogen gas shall always continue to be supplied to and exhausted from the chamber 6, and the amount of the nitrogen gas supplied will widely vary from step to step in the process of processing the semiconductor wafer W.

After the transport of the semiconductor wafer W into the chamber 6, the transport opening 66 is closed with the gate valve 185. The holder elevating mechanism 4 then moves the holder 7 from the transfer position up to the processing position that is in close proximity to the chamber window 61. During the upward movement of the holder 7 from the transfer position, the semiconductor wafer W is transferred from the support pins 70 to the susceptor 72 of the holder 7 and then placed and held on the upper surface of the susceptor 72. When the holder 7 is brought in the processing position, the semiconductor wafer W held on the susceptor 72 is also brought in the processing position.

Each of the six zones 711 to 716 of the hot plate 71 has been heated up to a given temperature by its own individual built-in heater (the resistance heating wires 76) in each zone (in the space between the upper plate 73 and the lower plate 74). With the holder 7 brought up to the processing position and in contact with the semiconductor wafer W, the semiconductor wafer W held thereon is preheated by the built-in heaters in the hot plate 71 so that its temperature rises gradually.

Figure 7A:
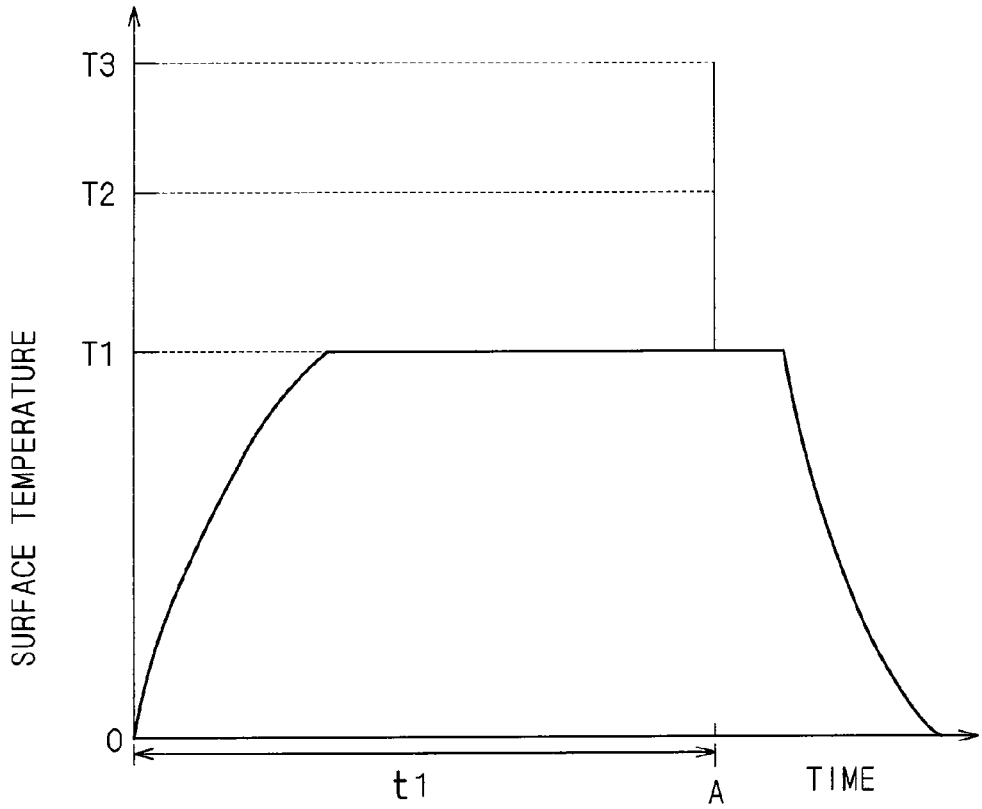
FIGS. 7A and 7B are graphs showing a change in the surface temperature of a semiconductor wafer.
Figure 7B:
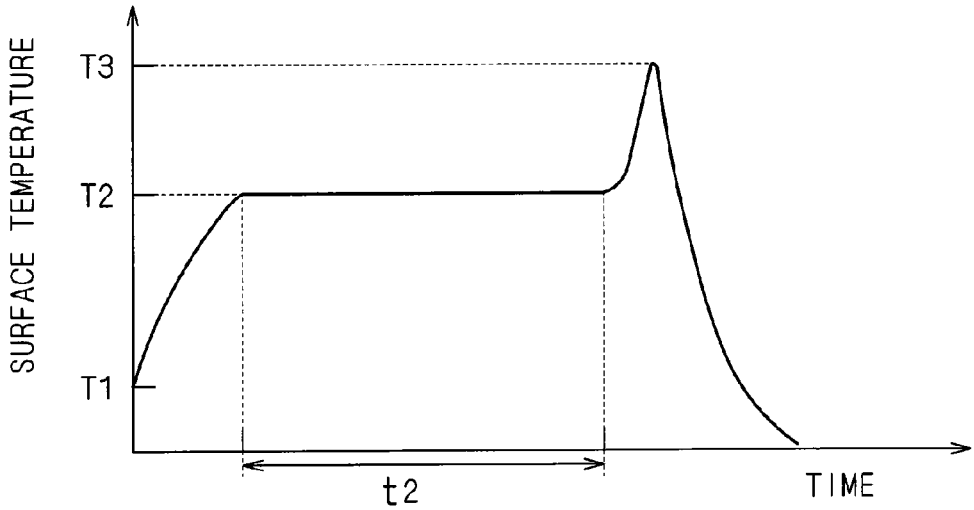

FIGS. 7A and 7B are graphs each showing a change in the surface temperature of the semiconductor wafer W. FIG. 7A shows a temperature change after the start of the preheating; and FIG. 7B shows, in enlarged scale, a temperature change at the time of light emission from the flash lamps FL (at time A in FIG. 7A). Preheating the semiconductor wafer W in the processing position for time t1 causes the temperature of the wafer W to rise to a preset preheating temperature T1. The preheating temperature T1 shall be on the order of 200 to 800° C., preferably on the order of 350 to 600° C. (600° C., in the present preferred embodiment), at which temperatures there is no apprehension that implanted impurities in the semiconductor wafer W will be diffused by heat. The preheating time t1 for the semiconductor wafer W shall be in the range of about 3 to 200 seconds (60 seconds, in the present preferred embodiment). The distance between the holder 7 and the chamber window 61 is arbitrarily adjusted by controlling the amount of rotation of the motor 40 in the holder elevating mechanism 4.

After the lapse of the preheating time t1, the flash lamps FL will start photoheating (photoannealing) of the semiconductor wafer W at the time A. For the light emission from the flash lamps FL, a charge has previously been stored in the capacitor 93, using the power supply unit 95. With the capacitor 93 in the charged state, a pulse signal is output from the pulse generator 31 in the controller 3 to the switching element 96.

Figure 8:
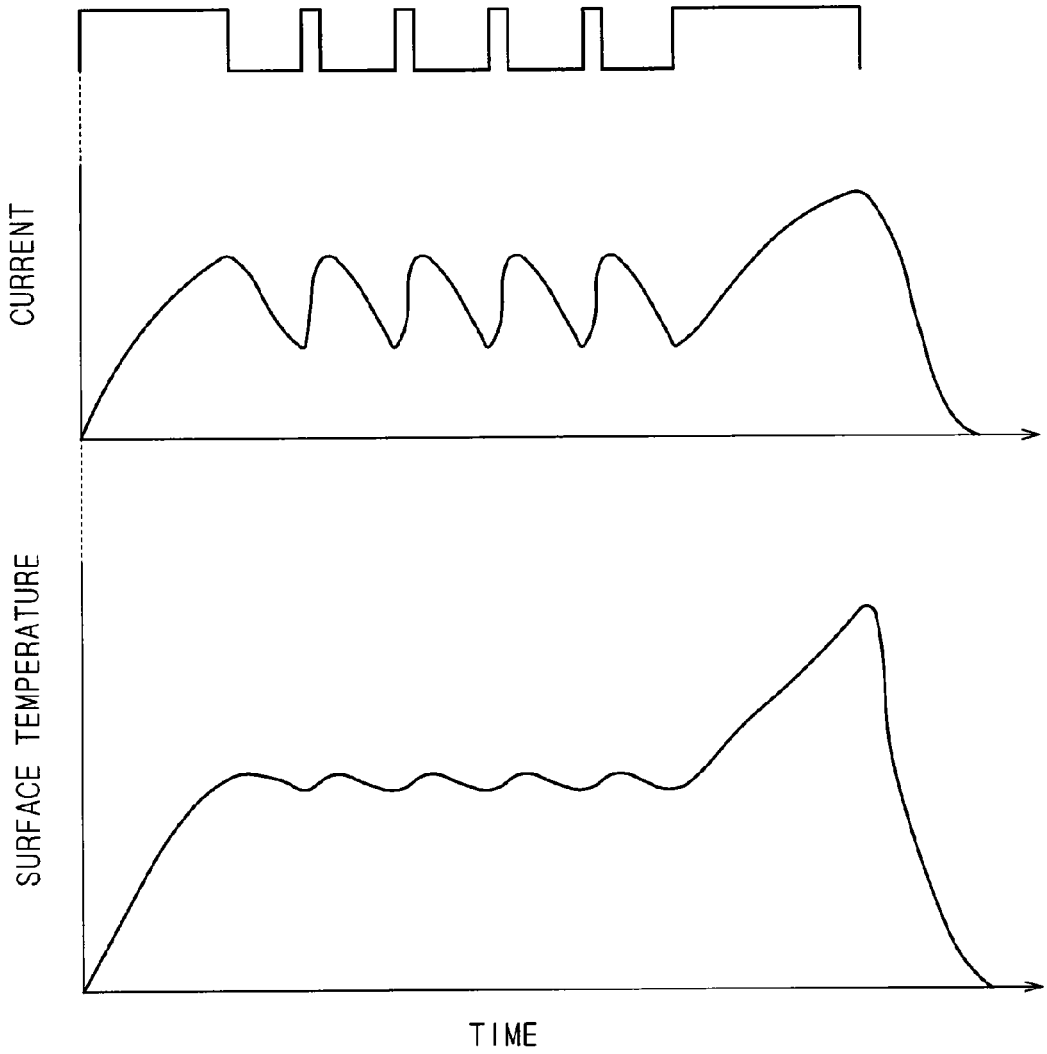
FIG. 8 illustrates by way of example the correlation of the waveform of a pulse signal with the current flowing through a circuit and with the surface temperature of a semiconductor wafer.

FIG. 8 shows, by way of example, the correlation of the waveform of a pulse signal with the current flowing through the circuit and with the surface temperature of the semiconductor wafer W. In the present example, the pulse generator 31 outputs a pulse signal with the waveform as illustrated in the upper row of FIG. 8. The waveform of this pulse signal will be defined by input of parameters, as shown in Table 1 below, from the input unit 33.

TABLE 1

| n | Pn | Sn |
|---|---|---|
| 0 | 800 | 400 |
| 1 | 100 | 400 |
| 2 | 100 | 400 |
| 3 | 100 | 400 |
| 4 | 100 | 400 |
| 5 | 1000 | 0 |

In Table 1, $P_n$ is the pulse width and $S_n$ is the space width, both in microseconds. The pulse width is the duration of time each pulse is at a high level; and the space width is the interval of time between pulses. When an operator inputs each parameter, namely the pulse width, the space width, and the number of pulses shown in Table 1, from the input unit 33 to the controller 3, the waveform setter 32 in the controller 3 sets a pulse waveform including six pulses as illustrated in the upper row of FIG. 8. As shown, the first and the last pulses are set to have relatively long pulse widths. The pulse generator 31 outputs a pulse signal with the pulse waveform determined by the waveform setter 32. The result is that the pulse signal with the waveform as illustrated in the upper row of FIG. 8 is applied to the gate of the switching element 96 to control drive of the switching element 96.

In synchronization with the timing of the turn-on of the pulse signal output from the pulse generator 31, the controller 3 controls and causes the trigger circuit 97 to apply voltage to the trigger electrode 91. Thus, when the pulse signal input to the gate of the switching element 96 is ON, a current will flow between the electrodes across the glass tube 92, and resultant excitation of atoms or molecules of xenon will induce light emission. The output of the pulse signal with the waveform as illustrated in the upper row of FIG. 8 from the controller 3 to the gate of the switching element 96, and the application of voltage to the trigger electrode 91 in synchronization with the timing of the turn-on of the pulse signal will produce a current flow as illustrated in the middle row of FIG. 8 in the circuit including the flash lamp FL. In other words, current will flow through the glass tube 92 of the flash lamp FL to cause light emission only when the pulse signal input to the gate of the switching element 96 is ON. A current waveform for each individual pulse shall be defined by the constants of the coil 94.

The light emission from the flash lamps FL with the current flow as illustrated in the middle row of FIG. 8 results in the photoheating of the semiconductor wafer W held by the holder 7 in the processing position, so that the surface temperature of the semiconductor wafer W will fluctuate as illustrated in the lower row of FIG. 8. If, as in conventional cases, the flash lamps FL emit light without the use of the switching elements 96, the emitted light will be very short and strong flashing light that can last for a time only on the order of 0.1 to 10 milliseconds, so that the surface temperature of the semiconductor wafer W will reach a maximum temperature in a matter of several milliseconds. On the contrary, when, as in the present preferred embodiment, the switching elements 96 are connected in the circuits and the pulse signal as illustrated in the upper row of FIG. 8 is output to the gates of the switching elements 96, the light emission from the flash lamps FL is, in a sense, under chopper control. This allows the charge accumulated in the capacitors 93 to be divided for consumption, so that the flash lamps FL will repeat flashing in a very short time.

In particular, when the pulse signal with the waveform as illustrated in the upper row of FIG. 8 is output to the switching elements 96, first with the light emission from the flash lamps FL based on the first pulses, the surface temperature of the semiconductor wafer W will rise from the preheating temperature T1 to a recovery temperature T2. The recovery temperature T2 shall be within a temperature range (first temperature range) of the order of 800 to 1200° C. (approximately 950° C., in the present preferred embodiment), in which range defects created in silicon crystals by the ion implantation will be reduced and make a recovery. Then, with subsequent repetitions of relatively short (100-microsecond) pulses at intervals of 400 microseconds, the flash lamps FL will repeat flashing so that the surface temperature of the semiconductor wafer W is maintained at the recovery temperature T2 during time t2 (FIG. 7B). The time t2 shall be in the range of 10 to 100 milliseconds. The time t2 of less than 10 milliseconds, during which the surface temperature of the semiconductor wafer W is maintained at the recovery temperature T2, will result in insufficient recovery of defects, while the time t2 of more than 100 milliseconds will induce a phenomenon of diffusion of implanted impurities.

After the lapse of the recovery time t2, the flash lamps FL will emit flashing light based on the last pulses. The flashing light emitted at this time from the flash lamps FL is very short and strong light that can last for a time only on the order of 0.1 to 10 milliseconds. With this flashing light emission, the surface temperature of the semiconductor wafer W will rise instantaneously from the recovery temperature T2 to a processing temperature T3. The processing temperature T3 shall be within the range of the order of 1000 to 1300° C. (approximately 1050° C., in the present preferred embodiment), in which range implanted impurities in the semiconductor wafer W will be activated. With the completion of this flashing light emission, the light emission from the flash lamps FL is complete so that the surface temperature of the semiconductor wafer W will drop rapidly.

With the completion of the photoheating and after approximately 10-second standby in the processing position, the holder 7 is again moved by the holder elevating mechanism 4 down to the transfer position in FIG. 1, in which the semiconductor wafer W is transferred from the holder 7 to the support pins 70. Then, the transport opening 66 which has been closed is opened with the gate valve 185 and the semiconductor wafer W placed on the support pins 70 is transported out using the transport robot outside the apparatus. This completes the photoannealing of the semiconductor wafer W in the heat treatment apparatus 1.

As previously described, the nitrogen gas continues to be supplied into the chamber 6 during the heat treatment of the semiconductor wafer W in the heat treatment apparatus 1. The amount of the supply shall be approximately 30 liters per minute when the holder 7 is in the processing position, while it shall be approximately 40 liters per minute when the holder 7 is in any position other than the processing position.

In the present preferred embodiment, a semiconductor wafer W preset to the preheating temperature T1 is irradiated with light from the flash lamps FL so that the surface temperature of the semiconductor wafer W is once increased to and maintained at the recovery temperature T2 during the time t2. Then, with the subsequent flashing light emission from the flash lamps FL, the surface temperature of the semiconductor wafer W is increased to the processing temperature T3 (second temperature) that is higher than the recovery temperature T2.

Maintaining the surface temperature of the semiconductor wafer W at the recovery temperature T2 during the time t2 with the light emission from the flash lamps FL allows a reduction and recovery of defects created in silicon crystals by the ion implantation. In addition, increasing the surface temperature of the semiconductor wafer W to the processing temperature T3 with the subsequent flashing light emission from the flash lamps FL allows activation of implanted impurities in the semiconductor wafer W. In this sequence of light emissions from the flash lamps FL, the time during which the surface temperature of the semiconductor wafer W is maintained at the recovery temperature T2 is the time t2 (10 to 100 milliseconds) and the time during which the surface temperature rises up to the processing temperature T3 is only a very short time of less than 10 milliseconds, which results in reduced diffusion of implanted impurities. In other words, the two-step increase in the surface temperature of a semiconductor wafer W with the light emission from the flash lamps FL, as illustrated in FIG. 7B, achieves both recovery of defects and activation of impurities with reduced impurity diffusion.

Since, in conventional flash heating, the surface temperature of a semiconductor wafer W have risen instantaneously from the preheating temperature T1 to the processing temperature T3 with flashing light emission, resultant sudden thermal expansion of the wafer surface could cause cracking of the semiconductor wafer W. In the present preferred embodiment, on the other hand, the surface temperature of a semiconductor wafer W is once increased to the recovery temperature T2 and then increased with the flashing light emission to the processing temperature T3. This considerably reduces the frequency of occurrence of wafer cracking. In other words, the two-step increase in the surface temperature of a semiconductor wafer W with the light emission from the flash lamps FL can also prevent cracking of the semiconductor wafer W.

While the preferred embodiment of the invention has been described so far, various modifications other than those described above can be made without departing from the spirit and scope of the invention. For instance, while in the preferred embodiment described above, the parameters (the pulse width, the space width, and the number of pulses) in Table 1 are input from the input unit 33 and the waveform setter 32 in the controller 3 sets the waveform of a pulse signal as illustrated in the upper row of FIG. 8, the pulse waveform is not limited to the one illustrated in the upper row of FIG. 8; the waveform determined by the waveform setter 32 may be changed as appropriate by changing input parameters. To achieve the effects of the preferred embodiment described above, however, it is necessary to set a pulse signal with a waveform that causes the surface temperature of a semiconductor wafer W to change in such a manner that, with light emission from the flash lamps FL, the surface temperature is maintained during a certain period of time within a temperature range (the first temperature range) that induces recovery of defects, and then with subsequent flashing light emission from the flash lamps FL, the surface temperature reaches a processing temperature (the second temperature) that is higher than the temperature range for recovery and that induces activation of impurities.

The way of setting the waveform of a pulse signal is not limited to step-by-step input of parameters, such as the pulse width, from the input unit 33; it may, for example, be direct operator input of a graphical waveform from the input unit 33; or a readout of a waveform that has been preset and stored in a storage such as a magnetic disk; or a download of a waveform from the outside of the heat treatment apparatus 1.

While the preferred embodiment described above employs IGBTs as the switching elements 96, the invention is not limited thereto; the switching elements 96 may be any transistor other than IGBTs as long as they are capable of turning the circuit on and off in response to the waveform of an input pulse signal. It should however be noted that since the flash lamps FL consume a considerably large amount of power for light emission, the switching elements 96 may preferably be IGBTs or GTO (gate turn-off) thyristors that are suitable for handling a large amount of power.

While in the preferred embodiment described above, the application of the voltage to the trigger electrodes 91 is in synchronization with the timing of the turn-on of a pulse signal, the timing of the application of the trigger voltage is not limited thereto; the trigger voltage may be applied at fixed intervals irrespective of the waveform of a pulse signal. If a pulse signal has a narrow space width so that the current caused by a certain pulse to flow through the flash lamps FL will remain more than a certain amount at the time when the next pulse starts to produce another passage of electric current, it is unnecessary to apply the trigger voltage for each pulse because there is a continuous current flow through the flash lamps FL. When all the space widths of a pulse signal are narrow as illustrated in FIG. 8 of the preferred embodiment described above, the trigger voltage may be applied only at the time of the application of an initial pulse, and thereafter, by only outputting the pulse signal as illustrated in the upper row of FIG. 8 to the gate of the switching element 96, the current waveform as illustrated in the middle row of FIG. 8 will be produced without the application of the trigger voltage. In other words, the timing of the application of the trigger voltage may be arbitrarily determined as long as the timing of the current flow through the flash lamp FL coincides with the turn-on of a pulse signal.

While the preferred embodiment described above provides 30 flash lamps FL in the lamp house 5, the invention is not limited thereto; the number of flash lamps FL may be arbitrarily determined. In addition, the flash lamps FL are not limited to xenon flash lamps, but may be krypton flash lamps.

Substrates to be processed by the heat treatment apparatus according to the invention are not limited to semiconductor wafers; they may be other substrates such as glass substrates for liquid crystal displays.

While the invention has been described in detail, the foregoing description is in all aspects illustrative and not restrictive. It is understood that numerous other modifications and variations can be devised without departing from the scope of the invention.

What is claimed is:

1. A heat treatment apparatus for heating a substrate by irradiation thereof with light, said heat treatment apparatus comprising:

a holder holding a substrate;

a flash lamp emitting light to the substrate held by said holder;

a switching element connected in series to said flash lamp, a capacitor, and a coil;

a pulse-signal generator generating and outputting a pulse signal including one or more pulses to said switching element to control drive of said switching element; and a waveform setter setting a waveform of the pulse signal generated by said pulse-signal generator, said waveform setter setting a waveform that causes a surface temperature of the substrate held by said holder to change in such a manner that, with light emission from said flash lamp, said surface temperature is maintained during a certain period of time within a first temperature range that induces recovery of defects, and then with subsequent flashing light emission from said flash lamp, said surface temperature reaches a second temperature that is higher than said first temperature range and that induces activation of impurities.

2. The heat treatment apparatus according to claim 1, wherein said waveform setter sets a waveform that causes said surface temperature to be maintained within said first temperature range of 10 to 100 milliseconds.

3. The heat treatment apparatus according to claim 1, wherein said switching element is a transistor, and said pulse-signal generator outputs a pulse signal to the gate of said transistor.

4. The heat treatment apparatus according to claim 3, wherein said transistor is an insulated-gate bipolar transistor.

5. A heat treatment apparatus for heating a substrate by irradiation thereof with light, said heat treatment apparatus comprising:

a holder holding a substrate;

a flash lamp emitting light to the substrate held by said holder;

a switching element connected in series to said flash lamp, a capacitor, and a coil; and a pulse-signal generator generating and outputting a pulse signal including one or more pulses to said switching element to control turning on and off of said switching element, said pulse-signal generator first repeating the turning on and off of said switching element so that, with light emission from said flash lamp, a surface temperature of the substrate held by said holder is maintained during a certain period of time within a first temperature range that induces recovery of defects; and then turning said switching element on so that, with flashing light emission from said flash lamp, said surface temperature reaches a second temperature that is higher than said first temperature range and that induces activation of impurities.

6. The heat treatment apparatus according to claim 5 wherein said pulse-signal generator repeats the turning on and off of said switching element so that said surface temperature is maintained within said first temperature range of 10 to 100 milliseconds.

7. The heat treatment apparatus according to claim 5 wherein said switching element is a transistor, and said pulse-signal generator outputs a pulse signal to the gate of said transistor.

8. The heat treatment apparatus according to claim 7, wherein said transistor is an insulated-gate bipolar transistor.

9. A heat treatment method for heating a substrate by irradiation thereof with light from a flash lamp, said heat treatment method comprising:

a waveform setting step of setting a waveform of a pulse signal including one or more pulses; and a light emitting step of outputting said pulse signal to a switching element to control drive of said switching element and thereby cause light emission from said flash lamp, said switching element being connected in series to a capacitor, a coil, and said flash lamp, said waveform setting step setting a waveform that causes a surface temperature of a substrate to change in such a manner that, with light emission from said flash lamp, said surface temperature is maintained during a certain period of time within a first temperature range that induces recovery of defects, and then with subsequent flashing light emission from said flash lamp, said surface temperature reaches a second temperature that is higher than said first temperature range and that induces activation of impurities.

10. The heat treatment method according to claim 9, wherein said waveform setting step sets a waveform that causes said surface temperature to be maintained within said first temperature range of 10 to 100 milliseconds.

11. A heat treatment method for heating a substrate by irradiation thereof with light from a flash lamp, said heat treatment method comprising:

a first heating step of causing light emission from said flash lamp so that a surface temperature of a substrate is maintained during a certain period of time within a first temperature range that induces recovery of defects; and a second heating step of, after said first heating step, causing flashing light emission from said flash lamp to the substrate so that said surface temperature reaches a second temperature that is higher than said first temperature range and that induces activation of impurities.

12. The heat treatment method according to claim 11, wherein in said first heating step, said surface temperature is maintained within said first temperature range of 10 to 100 milliseconds.

* * * * *